United States Patent [19]

Shy

[11] Patent Number: 4,842,248

[45] Date of Patent: Jun. 27, 1989

[54] HYDRAULIC ROD PUSHER-PULLER

[75] Inventor: Max H. Shy, Mauldin, S.C.

[73] Assignee: McLaughlin Mfg. Co., Inc., Greenville, S.C.

[21] Appl. No.: 110,331

[22] Filed: Oct. 20, 1987

[51] Int. Cl.[4] ..... E21B 19/00

[52] U.S. Cl. ..... 254/29 R

[58] Field of Search ..... 254/29 R, 30, 31, 105, 254/106

[56] References Cited

U.S. PATENT DOCUMENTS

| | | | |
|---|---|---|---|
| 2,685,430 | 8/1954 | Henke | 254/29 R |
| 2,742,258 | 4/1956 | Rosasco | 254/29 R |
| 2,882,011 | 4/1959 | Ripstein . | |
| 3,616,651 | 11/1971 | Chang et al. | 254/105 |
| 3,966,169 | 6/1976 | Schosek . | |
| 3,988,004 | 10/1976 | Schosek . | |
| 4,251,058 | 2/1981 | Schosek . | |
| 4,502,665 | 3/1985 | Yoder . | |

FOREIGN PATENT DOCUMENTS

| | | | |
|---|---|---|---|
| 949420 | 2/1964 | United Kingdom | 254/105 |

OTHER PUBLICATIONS

Anser, Millenium Corp., 1900 E. Golf Rd. M-100, Schaumburg, IL 60195, (Undated Brochure).

Causco Pusher/Borer, Causco Inc., P.O. Box 1921, Independence, MO 64055, (Undated Brochure).

The Elephant, Elephant Industries, Inc., P.O. Box 3626, North Fort Myers, FL 33903, (Undated Brochure).

Ditch Witch "312", The Charles Machine Works, Inc., P.O. Box 66, Perry, OK 73077, (Undated Brochure).

Duke Hydraulic Pushers, Bor-Tec Industries Inc., P.O. Box 505, Stockbridge, GA 30281, (Undated Brochure).

Hole-Mole, General Equipment Co., P.O. Box 334, Owatonna, MN 55060, (1982 Brochure).

Porta-Pusher I, Vermeer Manufacturing Co., Pella, Iowa 50219, (Undated Brochure).

Poweram, Poweram Corp., P.O. Box 62, Barron, WI 54812, (Undated Brochure).

Pow-R Mole (Heavy Duty), Pow-R Devices, Inc., 9605 Clarence Center Rd., Clarence Center, N.Y. 14032, (Undated Brochure).

Pow-R Mole PD-4, Pow-R, Devices Inc., Clarence Center, N.Y. 14032, (Undated Brochure).

Twin Draulic, M.E.P. Fabricating Co., 1248 Shappert Dr., Loves Park, IL 61111, (Undated Brochure).

*Primary Examiner*—Robert C. Watson

*Attorney, Agent, or Firm*—Richards, Harris, Medlock & Andrews

[57] ABSTRACT

An hydraulic apparatus is provided for pushing and pulling rod or pipe underground. The apparatus includes a frame for mounting an hydraulic cylinder and a carriage. The carriage is mounted for reciprocating movement along rails attached to the frame. The carriage includes a lower carriage plate, an upper guide plate, and left and right side plates for retaining an actuator slide connected to the hydraulic cylinder. The slide rides on a plurality of thrust roller disposed in a race between the slide and a wear plate mounted in the lower carriage plate. The top of the slide comprises a cam surface that cradles a pair of actuator rollers which bear against a corresponding cam surface on the bottom of an actuator key. The top portion of the actuator key extends through a slot in the upper guide plate and is attached to a lower clamp plate that cradles the rod or pipe. Clamping jaws are mounted on an upper clamp plate that is rigidly connected to the lower carriage plate and the upper guide plate and mounted a fixed distance above the upper guide plate. Actuation of the hydraulic cylinder causes the slide to move longitudinally relative to the carriage, thereby moving the cam surface so that the actuator rollers force the actuator key and lower clamp plate upward to grip the rod between the lower clamp plate and the jaws. Further actuation of the hydraulic cylinder causes the carriage and gripped rod to move as a unit along the rails to push or pull the rod underground.

3 Claims, 4 Drawing Sheets

HYDRAULIC ROD PUSHER-PULLER

TECHNICAL FIELD

The present invention relates to apparatus for moving cylindrical objects through the ground and, in particular, to hydraulically operated equipment for pushing and pulling rod or pipe underground.

BACKGROUND OF THE INVENTION

Hydraulic equipment for pushing and pulling rod or pipe is especially useful for installing underground conduit, such as wter and gas lines, with a minimum of excavation. When conduit must be placed under streets, lawns, or driveways, it may be highly impractical to excavate along the entire length of the conduit due to the destruction of property, rerouting of traffic, or great expense. Therefore, pipe pullers and pushers are well known in the art for driving pipe underground without the necessity of excavating more than a hole at each end of the pipe line.

The pipe pushers and pullers of the prior art have generally utilized a lever action for gripping the pipe. The gripping lever can be attached to a carriage that is mounted for reciprocating movement along rails of a frame. However, many of the gripping levers of presently available pipe pushers and pullers provide either insufficient gripping of the pipe or excessive shear force that can damage the outer surface of the pipe. This problem can be highly undesirable when the pipe or rod is intended for repeated use in tunneling underground conduit lines.

Therefore, a need has been identified for an hydraulic rod and pipe pusher-puller that grips the rod securely without damage during the power stroke, releases the rod completely during the reset stroke, and adjusts easily for providing pushing or pulling force on the rod.

SUMMARY OF THE INVENTION

The present invention provides an improvement in an hydraulic apparatus for pushing and pulling rod or pipe underground. The apparatus includes a frame, an hydraulic cylinder mounted on the frame, and a pipe-gripping carriage connected to the hydraulic cylinder for reciprocating movement along rails attached to the length of the frame.

The pipe-gripping carriage of the present invention includes a lower carriage plate, an upper guide plate spaced apart from and rigidly connected to the lower carriage plate, and left and right side plates mounted between the lower carriage plate and the upper guide plate for retaining an actuator slide connected to the hydraulic cylinder rod by means of a clevis and clevis pin. The slide is mounted on a plurality of thrust rollers disposed in a race on the bottom of the slide for reciprocating movement over a replaceable wear plate mounted in the lower carriage plate. The top of the slide comprises a cam surface that cradles a pair of actuator rollers that bear against a corresponding cam surface on the bottom of an actuator key mounted on top of the actuator rollers. The top portion of the actuator key extends through a slot in the upper guide plate and is attached to a lower clamp plate that cradles the pipe parallel to the line of reciprocating movement of the slide and the carriage. Clamping jaws are mounted on an upper clamp plate that is rigidly connected to both the lower carriage plate and the upper guide plate and mounted a fixed distance above the upper guide plate.

Actuation of the hydraulic cylinder rod causes the slide to move longitudinally relative to the carriage, thereby moving the cam surface of the slide so that the actuator rollers force the actuator key and lower clamp plate upward to grip the pipe between the lower clamp plate and the clamping jaws. Further actuation of the hydraulic cylinder rod causes the carriage and the gripped pipe to move as a unit along the rails of the frame.

When the hydraulic cylinder rod has reached the full extent of its travel, hydraulic pressure can be reversed to return the slide to its original position, thereby allowing the actuator key and lower clamp plate to fall away from the jaws and release the grip on the pipe. With the grip on the pipe released, the carriage can be returned to its starting point so as to regrip the pipe for another power stroke. Removable pins are placed in sockets in the lower carriage plate to act as stops against the clevis pin to limit movement of the slide in either direction. Selective placement of the stop pins allows the carrier to grip the pipe and provide a power stroke in either the pushing or the pulling direction.

As described herein, the present invention provides a smoothly actuating pipe-gripping carriage for pushing and pulling rod or pipe underground. In addition, the jaws and lower clamp plate of the carriage grip the pipe securely along a length of the pipe to preclude damage to the outer surface of the pipe.

BRIEF DESCRIPTION OF THE DRAWINGS

For a more complete understanding of the present invention and for further advantages thereof, reference is made to the following Description of the Preferred Embodiment taken in conjunction with the accompanying Drawings, in which.

DESCRIPTION OF THE PREFERRED EMBODIMENT

Figure 1:
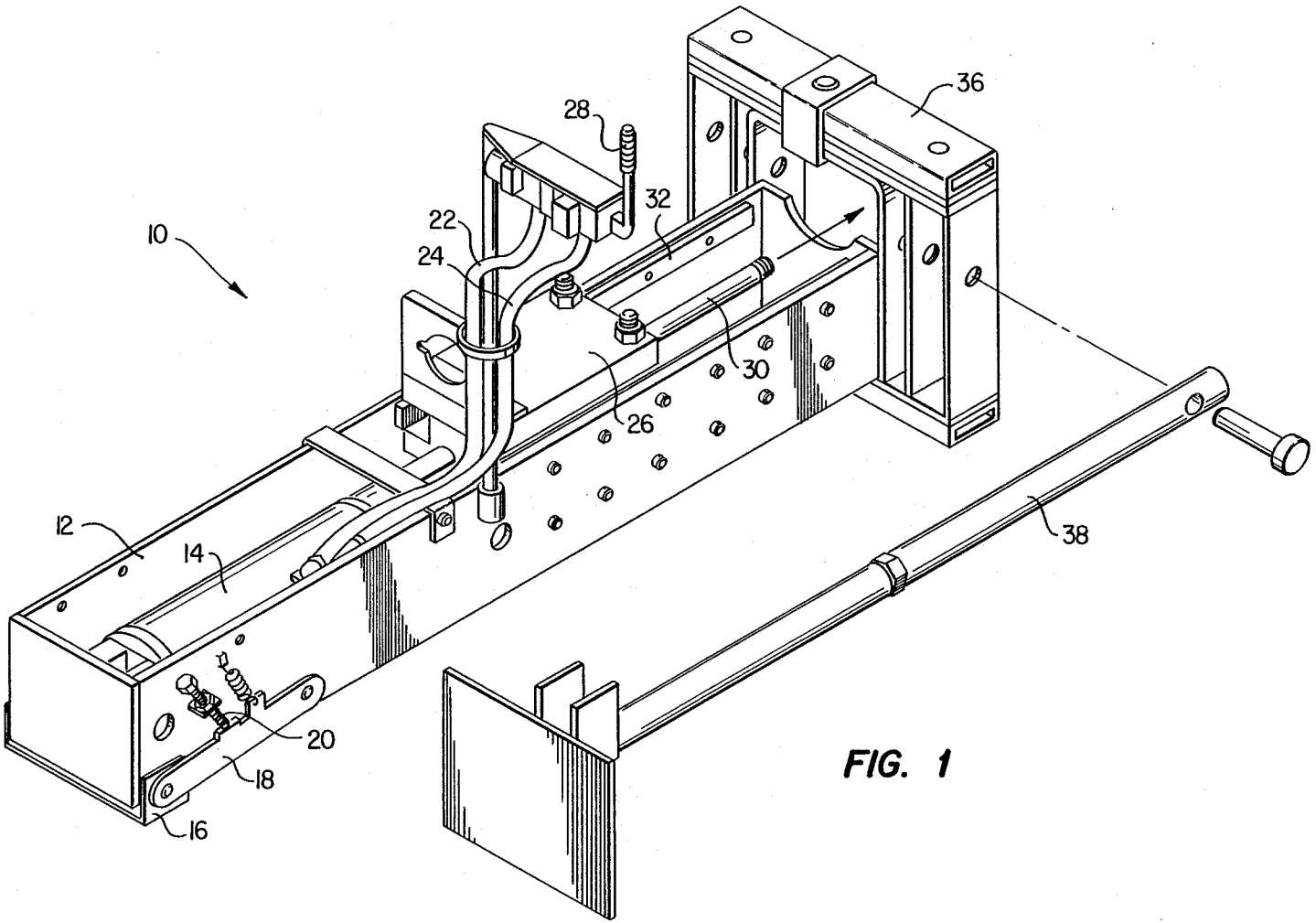
FIG. 1 is a perspective view of an hydraulic rod pusher-puller of the present invention.

Referring to the Drawings, wherein like reference numerals designate the same or similar parts throughout the several views, FIG. 1 is a perspective view of the hydraulic rod pusher-puller 10 of the present invention. Pusher-puller 10 comprises a frame 12 for mounting and supporting an hydraulic cylinder 14 and a movable carriage 26. Frame 12 is an elongated box-like structure having front, rear, and side plates. A positioning and stabilizing brace 36 is attached to the front of frame 12. A leveling shoe 16 is attached to the rear of frame 12 by means of a pivot bracket 18 having an adjusting bolt 20. An adjustable stabilizing bar 38 can be mounted on both sides of frame 12 to provide additional support for pusher-puller 10.

Hydraulic cylinder 14 is connected to an hydraulic pressure source (not shown) by means of hydraulic lines 22 and 24 as is well known in the art. The operation of hydraulic cylinder 14 is controlled by a control handle 28. Hydraulic cylinder 14 is connected to carriage 26 to provide hydraulic power for reciprocating movement of carriage 26 along rails 32 attached to the sides of frame 12. Carriage 26 comprises structure for gripping sections of rod or pipe 30 to be pushed or pulled underground by hydraulic cylinder 14.

Figure 2:
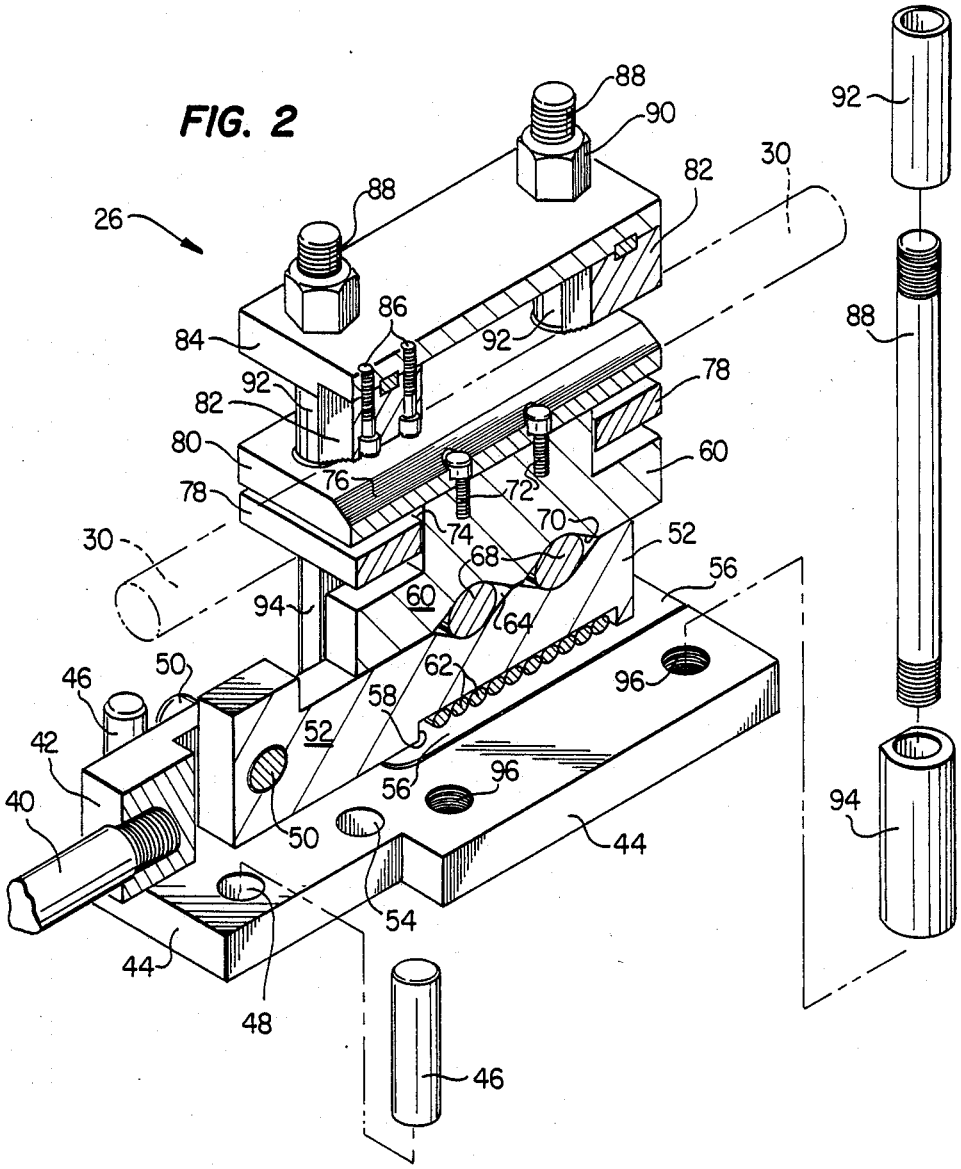
FIG. 2 is a cut-away perspective view of the pipe-gripping carriage of the present invention.

FIG. 2 is a perspective view of carriage 26 of pusher-puller 10 in partial longitudinal cross-section. A lower carriage plate 44 serves as a base for supporting the other components of carriage 26. A cylinder rod 40 of hydraulic cylinder 14 is attached to a clevis 42 that is connected to an actuator slide 52 by means of a clevis pin 50. Slide 52 includes a race 58 for confining a plurality of thrust rollers 62. Slide 52 is supported by thrust rollers 62 that roll on a removable wear plate 56 mounted in lower actuator plate 44. Slide 52 has a cam surface 64 on its top that cradles a pair of actuator rollers 68. An actuator key 60 has a cam surface 70 corresponding to slide cam surface 64. Actuator key 60 is mounted atop slide 52 and thrust rollers 68. The top portion of actuator key 60 extends through a slot 74 is an upper guide plate 78. A lower clamp plate 80 is mounted above upper guide plate 78 and attached to the top of actuator key 60 by means of machine screws 72. Lower clamp plate 80 has a longitudinal V-shaped groove 76 for supporting a section of rod or pipe 30, shown in phantom in FIG. 2. An upper clamp plate 84 includes a pair of jaws 82 attached by means of machine screws 86. Upper clamp plate 84 and upper guide plate 78 are spaced-apart and rigidly connected in parallel relationship to lower actuator plate 44 by four bolts 88 mounted vertically in threaded bores 96. Sleeves 92 and 94 surround bolts 88. Sleeves 94 maintain upper guide plate 78 at a fixed distance above lower actuator plate 44 and sleeves 92 maintain upper clamp plate 84 a fixed distance above upper guide plate 78. Hex-head nuts 90 are threaded onto bolts 88 to rigidly secure plates 84, 78, and 44 in spaced-apart relationship. Pins 46 may be placed selectively in sockets 48 or 54 as a stop for clevis pin 50 to selectively restrict the forward or reverse motion of slide 52.

Figure 3:
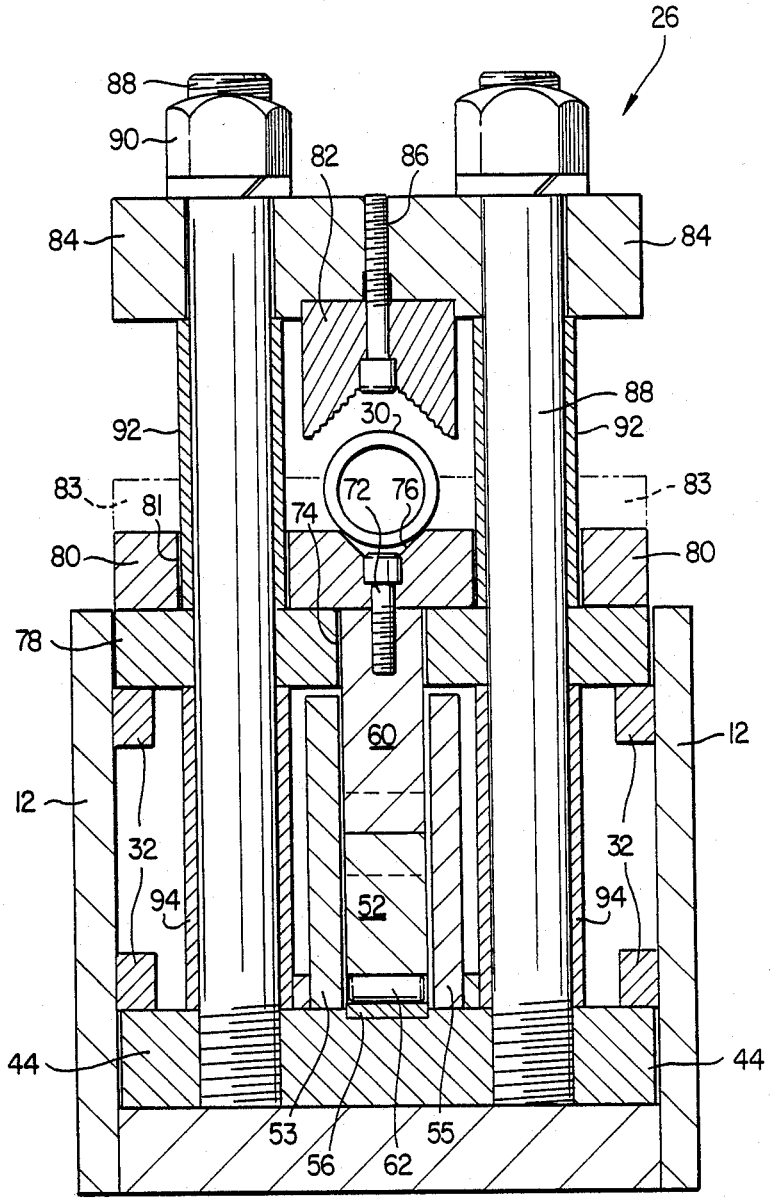
FIG. 3 is a cross-section of the carriage of the present invention.

FIG. 3 is a modified cross section of carriage 26 mounted in frame 12. Frame 12 includes rails 32 attached on the inside of the side plates of frame 12. Lower actuator plate 44 rides below the bottom rails 32 and upper guide plate 78 rides above the top rails 32. A left side plate 53 and a right side plate 55 are mounted on lower actuator plate 44 on either side of slide 52 and actuator key 60 to retain thrust rollers 62, slide 52, actuator rollers 68, and actuator key 60 in proper alignment. Lower clamp plate 80 includes bores 81 having diameters greater than the outside diameter of sleeves 92 so that lower clamp plate 80 may reciprocate vertically with respect to carriage 26, as illustrated in phantom showing the upper position 83 of clamp plate 80. The remaining components illustrated in FIG. 3 correspond to the similarly numbered components illustrated in FIG. 2. It should be understood that various nuts, bolts, cover plates, and other common items well known in the art have been deleted from the FIGURES for the purpose of clarifying the illustration of the present invention.

Figure 4A:
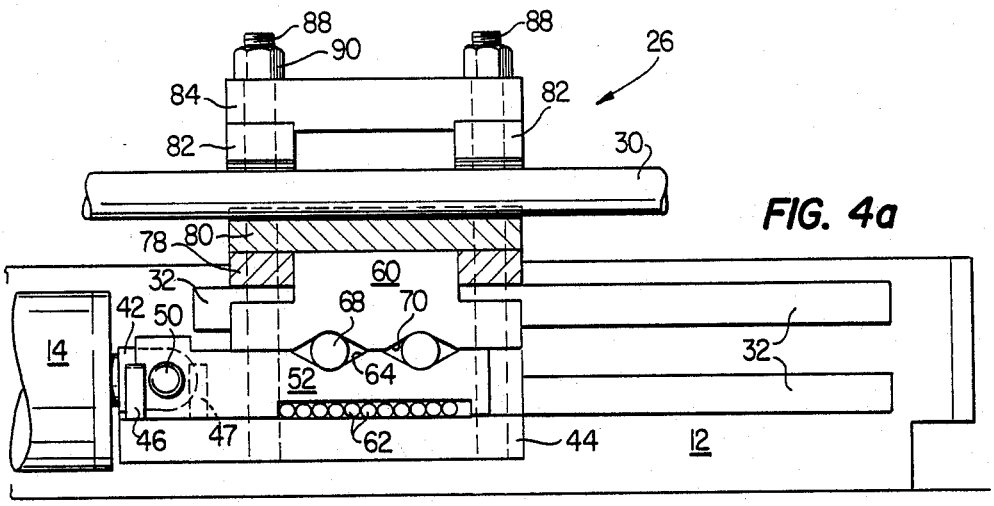
FIGS. 4*a*–4*c* are cut-away side views of the present invention illustrating the action of the pipe-gripping carriage of the present invention.
Figure 4B:
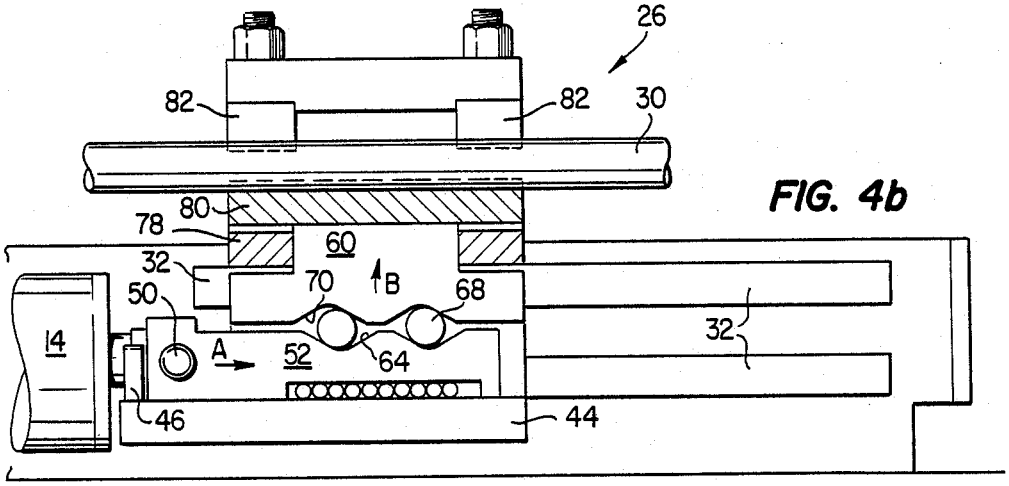
Figure 4C:
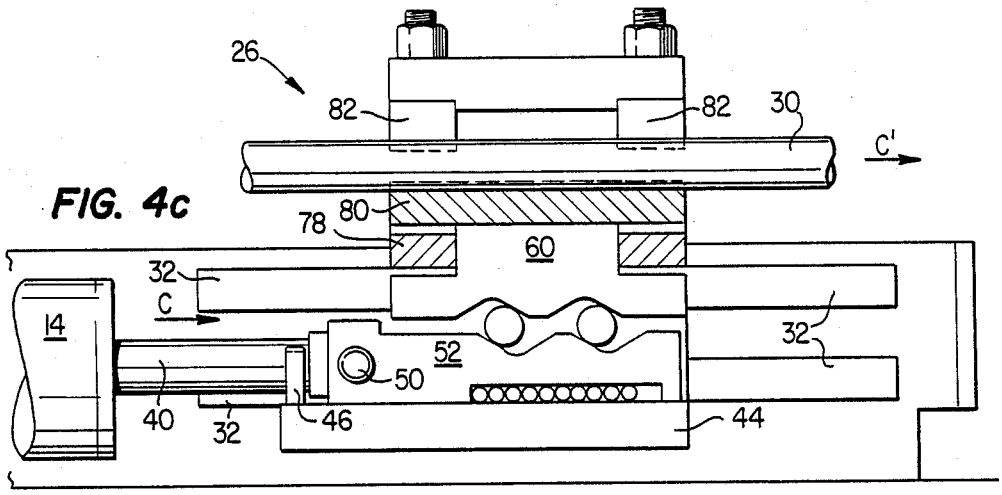

FIGS. 4*a*–4*c* are simplified, partially cut away side views of pusher-puller 10 illustrating the action of carriage 26. In FIG. 4*a*, pusher-puller 10 is shown at an initial position with a segment of pipe 30 placed loosely in an unclamped position between lower clamp plate 80 and upper jaws 82. Upon initial actuation of hydraulic cylinder 14, as shown in FIG. 4*b*, slide 52 is forced in the direction of arrow A with respect to carriage 26, which remains stationary initially due to the friction of carriage 26 on rails 32. The motion of slide 52 offsets cam surface 64 of slide 52 with respect to cam surface 70 of actuator key 60 so that thrust rollers 68 cause actuator key 60 to move upward in the direction of arrow B. Lower clamp plate 80, which is attached to actuator key 60, moves upward with actuator key 60 so as to clamp pipe 30 between lower clamp plate 80 and upper jaws 82.

When pipe 30 becomes tightly gripped between lower clamp plate 80 and upper jaws 82, slide 52 will move no further with respect to actuator key 60. Continued actuation of hydraulic cylinder 14 after pipe 30 has been gripped extends cylinder rod 40 as illustrated in FIG. 4C. Extension of cylinder rod 40 in the direction of arrow C forces carriage 26 and pipe 30 to move together along rails 32 in the direction of arrow C′ to force pipe 30 through the earth in front of pusher-puller 10. When cylinder rod 40 has reached the limit of its extension, hydraulic pressure may be reversed to retract carriage 26 to its initial position. Upon retraction of cylinder rod 40, slide 52 moves in the direction opposite arrow C until clevis pin 50 contacts stop pins 46 mounted in the lower actuator plate 44. When clevis pin 50 contacts stop pins 46, the cam surfaces of slide 52 and actuator key 60 are realigned so that actuator key 60 and lower clamp plate 80 fall away from jaws 82 to release the grip on pipe 30. With the grip on pipe 30 released, carriage 26 is retracted toward hydraulic cylinder 14 along rails 32 while pipe 30 remains stationary. When carriage 26 returns to the initial position illustrated in FIG. 4*a*, a new section of rod may be connected to pipe 30 and the rod gripping and pushing sequence may be repeated to push pipe 30 further under the ground.

Pulling operation of pusher-puller 10 can be accomplished by moving stop pins 46 to the position 47 illustrated in phantom in FIG. 4a. With the stop pins in position 47, clevis pin 50 contacts pins 47 so that slide 52 does not move forward with respect to actuator key 60 during extension of cylinder rod 40 in the direction of arrow C. Thus, carriage 26 can be extended to its forward limit without gripping and moving pipe 30. However, during retraction of cylinder rod 40, slide 50 moves with respect to carriage 26 so that actuator key 60 and lower clamp plate 80 move upward to clamp pipe 30 between plate 80 and jaws 82. Continued retraction of cylinder rod 40 pulls carriage 26 and the gripped pipe 30 toward hydraulic cylinder 14 along rails 32 in the direction opposite arrow C′. This pulling sequence can be repeated until pipe 30 has been completely withdrawn from its underground tunnel.

Although the present invention has been described with respect to a specific embodiment thereof, various changes and modifications may be suggested to one skilled in the art, and it is intended that the present invention encompass such changes and modifications as fall within the scope of the appended claims.

I claim:

1. Apparatus for moving a rod or pipe along its longitudinal axis, comprising:

a frame having an hydraulic actuator and an actuator plate mounted therein;

a slide connected to said hydraulic actuator and mounted on said actuator plate for reciprocating motion parallel to said longitudinal axis;

a guide plate rigidly mounted on said actuator plate in spaced-apart parallel relationship therewith;

an actuator key mounted atop said slide and extending through a slot in said guide plate;

said slide and said actuator key having corresponding cam surfaces with an actuator roller disposed therebetween for converting longitudinal motion of said slide into vertical motion of said actuator key;

a lower clamp plate mounted atop said actuator key and disposed above said guide plate;

a jaw attached to an upper clamp plate rigidly mounted on said actuator plate in spaced-apart parallel relationship with said guide plate for gripping the rod between said jaw and said lower clamp plate;

said actuator plate, guide plate, clamp plates, actuator key, and slide forming a rod-gripping carriage mounted for longitudinal reciprocating motion along rails attached to said frame.

2. The apparatus of claim 1, further comprising stop pins selectively insertable into sockets in said actuator plate for selectively limiting the forward or reverse longitudinal motion of said slide.

3. The apparatus of claim 1, wherein said slide includes a race for confining a plurality of thrust rollers between said slide and said actuator plate.

* * * * *